US005966771A

United States Patent [19]

Stroud

[11] Patent Number: 5,966,771

[45] Date of Patent: Oct. 19, 1999

[54] POLYMERIC MOLDED SWEEPING DEVICE

[75] Inventor: Edward H. Stroud, Perth, Australia

[73] Assignee: Noblecrest Marketing Pty., Ltd., Perth, Australia

[21] Appl. No.: 08/945,201

[22] PCT Filed: Feb. 12, 1996

[86] PCT No.: PCT/AU96/00068

§ 371 Date: Oct. 10, 1997

§ 102(e) Date: Oct. 10, 1997

[87] PCT Pub. No.: WO96/25067

PCT Pub. Date: Aug. 22, 1996

[30] Foreign Application Priority Data

Feb. 16, 1995 [AU] Australia ..... PN1181
Aug. 4, 1995 [AU] Australia ..... PN4606

[51] Int. Cl.[6] ..... A46B 3/04

[52] U.S. Cl. ..... 15/117; 15/187; 15/188; 300/21; 264/243

[58] Field of Search ..... 15/117, 188, 187; 300/21; 264/243

[56] References Cited

U.S. PATENT DOCUMENTS 4,480,351 11/1984 Koffler ..... 15/187
4,685,423 8/1987 Baker et al. ..... 15/104.93

FOREIGN PATENT DOCUMENTS

25623/57 5/1958 Australia .
81674/82 9/1983 Australia .
8281674 9/1983 Australia .
57750/90 3/1991 Australia .
120299 3/1984 European Pat. Off. .
941364 4/1956 Germany .
82/6208 8/1982 South Africa .
83/7171 9/1983 South Africa .
94/04057 3/1994 WIPO .

*Primary Examiner*—Mark Spisich
*Assistant Examiner*—Theresa T. Snider
*Attorney, Agent, or Firm*—Sheridan Ross P.C.

[57] ABSTRACT

A sweeping device such as a head for a broom. The device has a first portion (22), including a socket (18) formed as an integral moulding of a relative hard polymeric material. A bristle portion (24) formed from a relatively soft polymeric material is molded to partially envelop the first portion and to engage positively with a groove (32) and undercut (34) formed in the first portion in order to attach the bristle portion to the first portion. The bristle portion is formed with a plurality of integral bristles (20) some of which may have a different cross section from that of the remainder of the bristles.

19 Claims, 4 Drawing Sheets

POLYMERIC MOLDED SWEEPING DEVICE

FIELD OF THE INVENTION

The present invention relates to a sweeping device and in a particular non-limiting aspect relates to a sweeping device which can be produced by a two stage process of moulding plastics material.

BACKGROUND OF THE INVENTION

There are numerous types of broom head constructions. A typical broom head construction of the same general nature as that provided by applicant's invention includes a head portion which may often be formed of wood or similar material having a plurality of holes drilled therethrough. The holes are used to locate and attach a number of bristles which protrude below the broom head. In addition, a socket may be provided as a separate element attached to the head or alternatively it may simply comprise a hole drilled in the upper part of the head. Whilst such broom head constructions are effective, there is an unacceptably high number of operations involved in the shaping of the head, the formation of the holes, the cutting of the bristles to size, attachment of socket and broom handle and finally the attachment of the bristles in the plurality of holes.

More recently it has been proposed to produce broom heads by a plastics moulding operation. Thus it is possible to mould the broom head, the socket for a broom stick and the bristles in one operation. However, construction of a broom head in this manner leads to unacceptable compromises as it is generally necessary to use a relatively soft material for the material forming the bristles whereas it is preferred that the material of the head portion and socket be relatively hard. This is because the head portion and socket must be used to transfer the force of a broom user to the bristles without the head and socket bending or becoming distorted. Where the broom is made in a single moulding operation, because the bristles, head and socket are all made of the same material, generally speaking, the bristles may be too hard because the plastics material has been chosen to provide sufficient hardness for the head and socket, or alternatively the head and socket are too soft because the plastics material has been chosen to provide good bristle properties.

Thus there is a need for an alternative broom construction which can be formed using a plastics moulding operations yet can provide a broom with relatively soft bristles and a relatively hard head and socket.

DISCLOSURE OF THE INVENTION

In one aspect the invention provides a sweeping device including a head portion having an upper surface and a lower surface, a socket for attaching the sweeping device to a broom stick formed on the upper surface, and a moulded bristle portion having a plurality of integrally formed bristles engaged with the head portion, the bristle portion being formed of a material of lesser hardness than the material forming the head portion.

The head portion may be moulded. It may be formed of a polymeric material. The head portion may have a Shore hardness (as measured in the A scale) in excess of 70.

Suitably the polymeric material includes polypropylene or a copolymer of polystyrene and polypropylene. It may include a filler. Preferably the filler may comprise 10% to 40% by weight of the polymeric material, more preferably 15% to 25% by weight. Talc is a suitable filler. The polymeric material may include a fibrous reinforcement. The fibrous reinforcement may include glass fibre. The fibrous reinforcement suitably comprises 10% to 20% by weight of the polymeric material.

The bristle portion may be moulded. It may be formed of a bristle composition incorporating a polymeric material. The bristle composition may include one or more fillers and/or reinforcement materials. Preferably the bristle composition will include a proportion of rubber material. It may also include a proportion of plastics material.

Suitably the socket is formed integrally with the head portion. The socket may be located intermediate the ends of an elongate reinforcement member forming part of the head portion. One or more reinforcing webs may extend between the socket and the elongate reinforcement.

Attachment means may be provided on the head portion to facilitate attachment of the bristle portion thereto. The attachment means may include profile features on the bristle portion. Preferably the profile features include one or more grooves, recesses or raised portions. Most preferably, the profile features include a groove. The groove may be provided on the upper surface of the reinforcement member. Suitably the groove extends substantially around the reinforcement member near the perimeter thereof. The groove may be undercut.

Preferably the upper surface of the head portion is stepped. The groove is most suitably formed in a stepped portion of the reinforcement member.

Raised portions may suitably be provided on the lower surface of the reinforcement member. The raised portions may be in the form of projections, lugs or stippling.

The bristle portion may overlie and/or envelop part of the attachment means. It may be provided with a plurality of integral bristles which extend beneath the lower surface of the head portion.

A proportion of the bristles may have a greater cross-sectional area than the remainder of the bristles.

A proportion of the bristles may have a D shaped rectangular or square cross section.

Preferably the bristle portion is formed with a squeegee blade.

In accordance with another aspect of the present invention there is provided a method of manufacturing a sweeping device, including the steps of moulding a head portion with a socket extending therefrom and moulding a bristle portion of softer material than the material forming the head portion to overlie and partially envelop the first portion to attach the bristle portion to the head portion.

Preferably the material of the bristle portion is moulded to overlie and engage one or more recessed and/or projecting proportions formed in the head portion.

Suitably the bristle proportion is moulded onto the head portion in such a manner as to leave the socket and central portion of the head portion free of overlap with the bristle portion.

The present invention will now be described by way of example with reference to the accompanying drawings.

DETAILED DESCRIPTION OF THE PREFERRED EMBODIMENT

Figure 1:
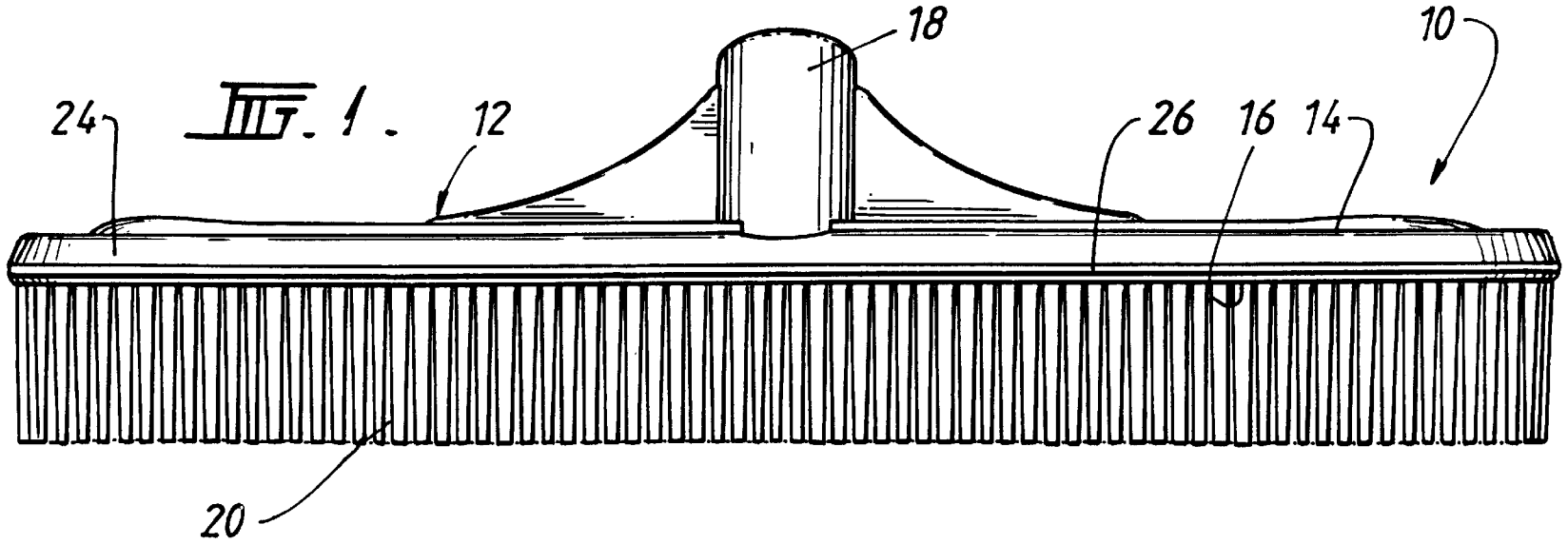
FIG. 1 is a front elevation of a sweeping device in accordance with the present invention.
Figure 2:
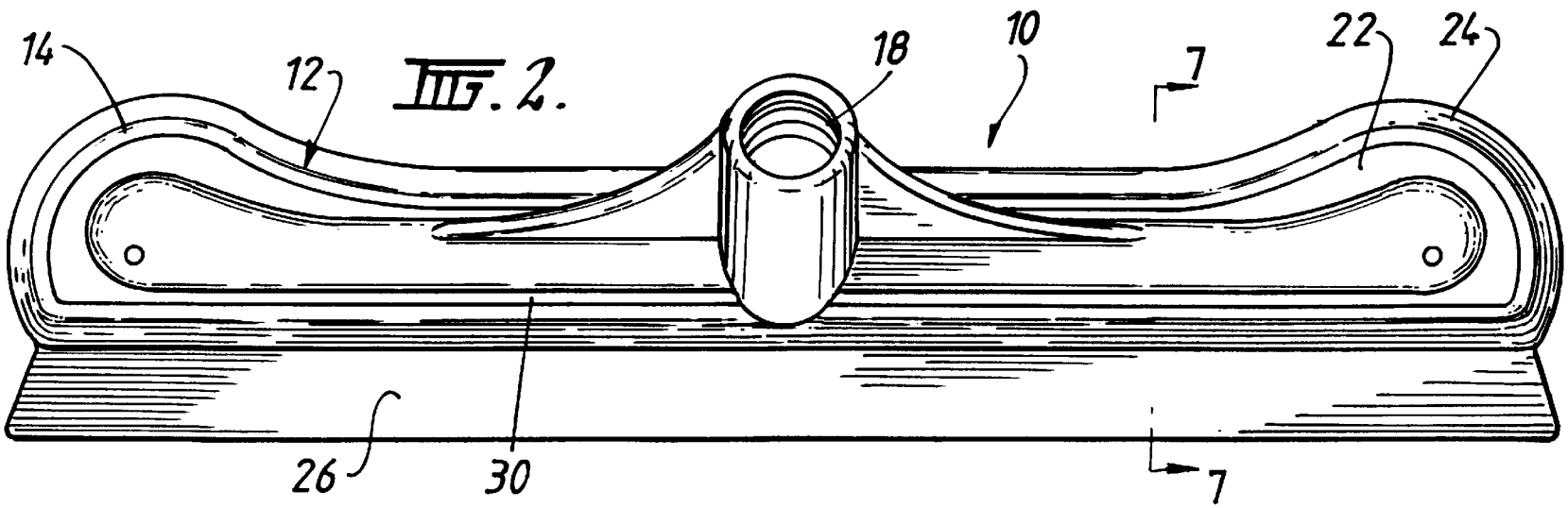
FIG. 2 is a plan view of the sweeping device of FIG. 1.
Figure 3:
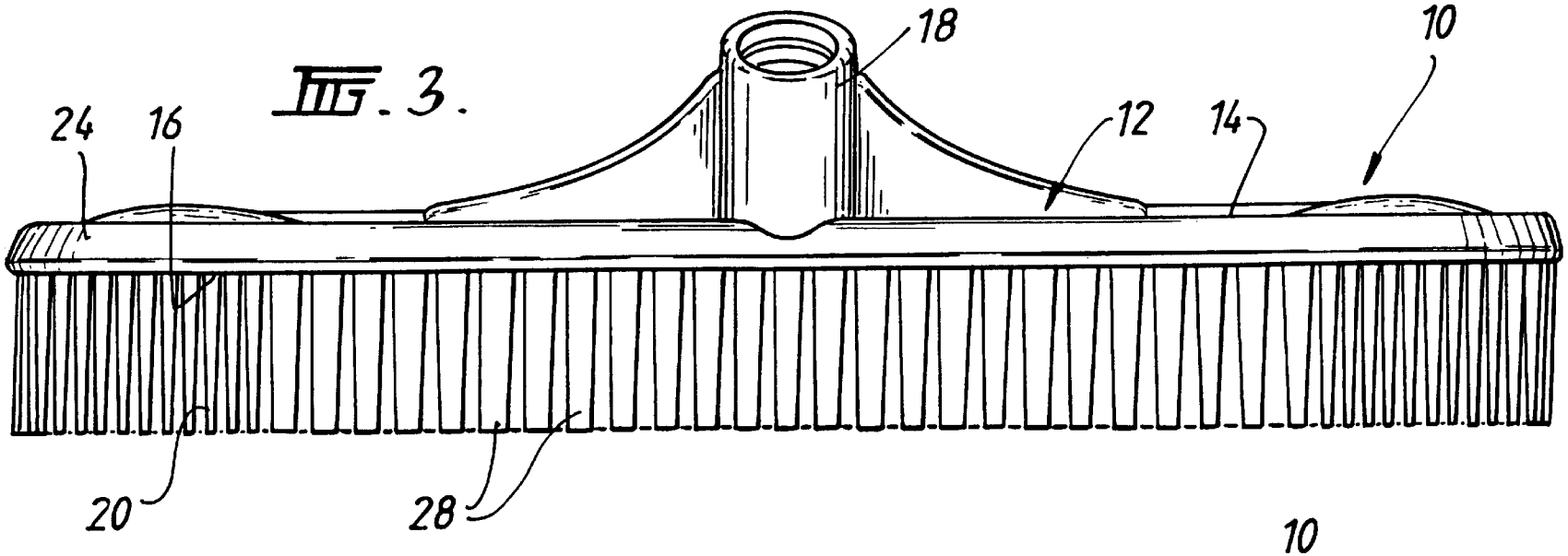
FIG. 3 is a rear view of the sweeping device of FIG. 1.

In the drawings there is shown a sweeping device 10 comprising a head 12 having an upper surface 14 and lower surface 16. A socket 18 is located on the upper surface for attachment of a broom stick (not shown) to the head 12.

Further, a plurality of bristles 20 extend from the lower surface 16.

The head 12 comprises a first portion 22 which is in the form of a first integral moulding of a relatively hard polymeric material. The first portion 22 includes an upper surface 30 which is stepped. A groove 32 is provided in the lower step and is formed by the under cut 34 extending around the first portion 22. The socket 18 is located intermediate the ends of the first portion. It forms an integral part of the first portion and is reinforced by two transverse webs extending to the relatively flat elongate region of the first portion 22 from either side of the socket.

The first portion 22 may be formed of a plastics material, such as polypropylene, which may contain a proportion of talc such as about 20% by weight, for increased hardness. On its lower surface 36 the first portion 22 preferably has a series of integral projections 38 formed thereon. The head 12 also comprises a second portion 24 which is in the form of a second integral moulding of a relatively soft polymeric material. The second portion 24 may be formed of a combination of rubber and plastics material. Further, the second portion preferably has a Shore A hardness of 35 to 85, more preferably 50 to 75 and most preferably 60 to 70, to give a good sweeping action.

The second portion 24 has projecting from its lower surface the bristles 20.

The head 12 is typically manufactured by first moulding the first portion 22 in a single piece complete with the socket 18 and the peripheral groove 32 and the projections 38 described above. The first portion 22 is then placed in a further mould and the material of the second portion is injection moulded into the second mould. The material of the second portion 24 enters the peripheral groove 32 and engages therewith. This engagement is positively reinforced by the undercut in the groove as the material of the second portion 24 engages with the undercut.

Further, the projections 38 on the underside of the first portion 22 engage with the material of the second portion 24 to ensure a positive engagement between the first and second portions 22 and 24 in this region of the sweeping device 10.

It is preferred that the central portion of the upper surface of the first portion 22 be free of the material of the second portion 24. To achieve this, in the second mould, the upper surface of the first portion is typically pushed hard against the roof of the second mould. This may be achieved by deleting some of the bristles 20 and replacing some of the second mould with metal rods which push the upper surface of the first portion 22 up against the roof of the second mould. In this way the central portion of the upper surface of the first portion 22 can be kept substantially free of the material of the second portion.

Figure 4:
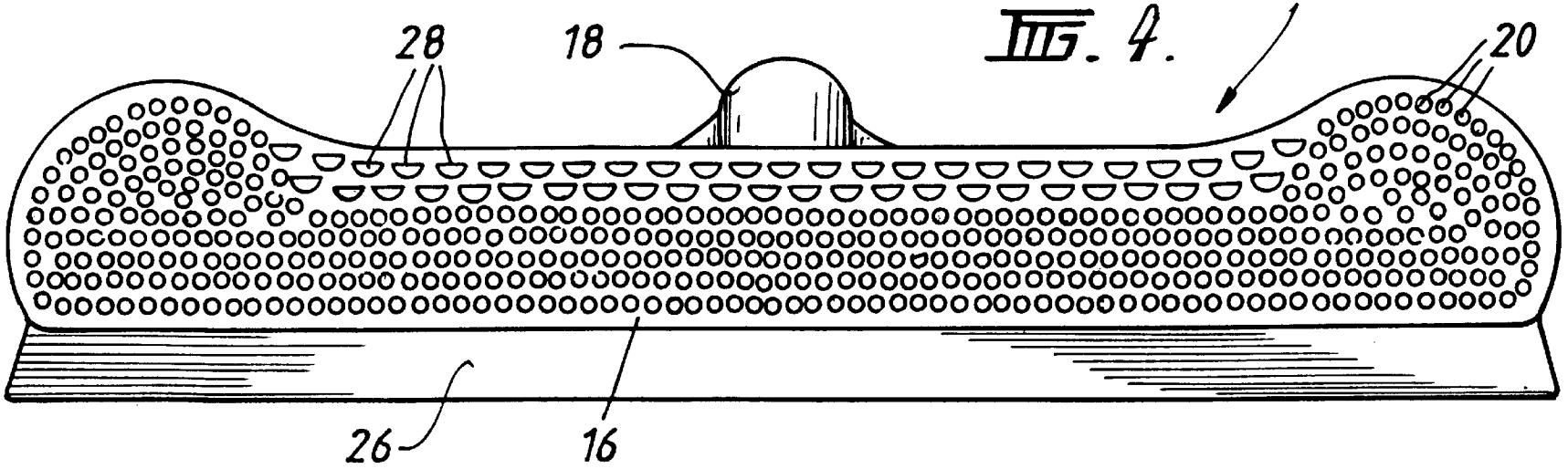
FIG. 4 is an underneath view of the sweeping device of FIG. 1.

Furthermore, as can be seen in FIG. 4, at least some of the bristles denoted by the reference numeral 28 have a larger cross-section or longer perimeter than the other bristles. Whilst the bristles 28 are illustrated as having a D shaped cross section, it is to be understood that other cross-sections such as square, rectangular, hexagonal, etc may be employed as well. The D shaped or other shaped bristles can be anywhere on the sweeping device 10 such as at the back or at the front or all over the device 10. The D shaped bristles help to pick up fine hair or lint. The embodiment shown works better with a pull toward action as the D bristles are at the rear of the sweeping device 10.

Figures 5, 6, 7:
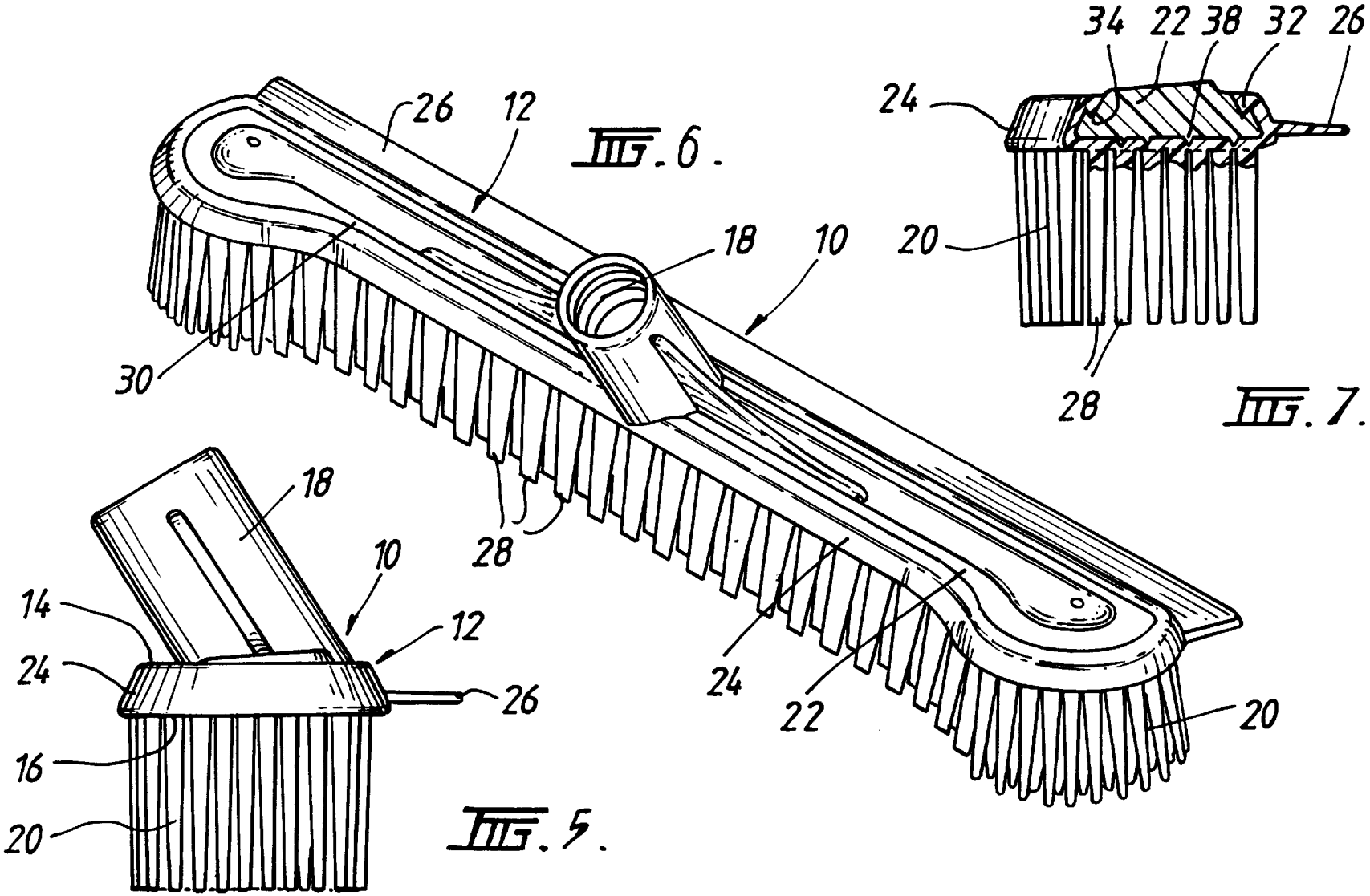
FIG. 5 is a side elevation of the sweeping device of FIG. 1.
FIG. 6 is an upper perspective view of the sweeping device of FIG. 1.
FIG. 7 is a cross section 7/7 on FIG. 2.
Figure 8:
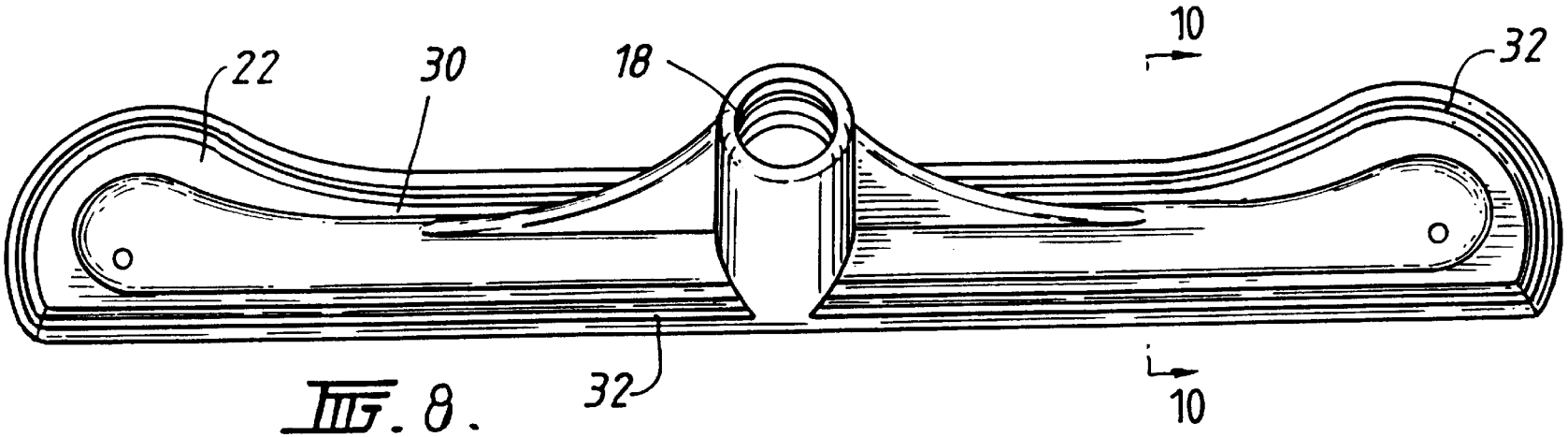
FIG. 8 is a plan view of a moulding component forming part of the sweeping device shown in FIG. 1.
Figure 9:
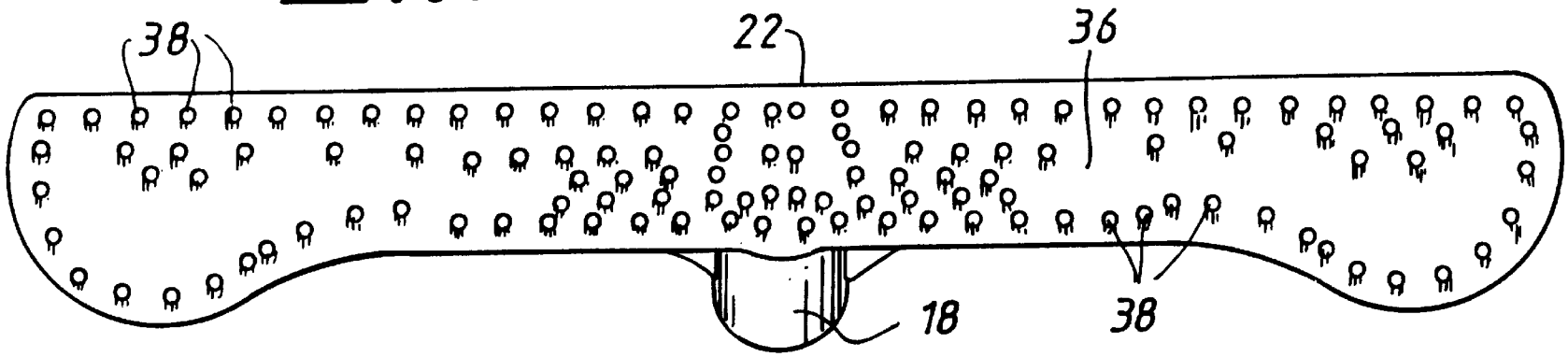
FIG. 9 is an underneath view of the component shown in FIG. 8.
Figure 10:
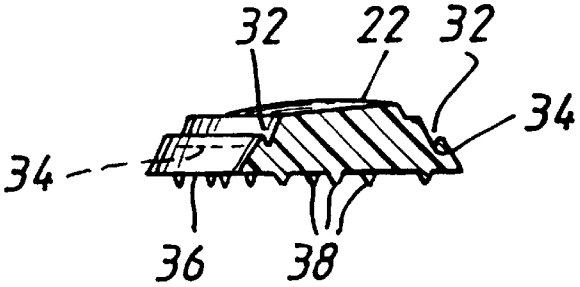
FIG. 10 is a cross-section 10/10 on FIG. 8.

The use of the polymeric material for the second portion including the bristles 20, has the advantage that the polymeric material may become electrostatically charged and may attract dust particles and hairs thereto. Also, as can be seen in FIG. 5, the second portion 24 preferably includes a forwardly projecting squeegee blade 26.

The use of a harder material for the first portion makes it easier to control the second portion which includes bristles by way of keeping it in even contact with a surface being swept. If the first portion is too soft the socket portion forming part of the first portion may bend causing the broom head to tilt with the result that only one edge of the bristles contacts the surface being swept.

While it has been convenient to describe the invention herein in relation to particularly preferred embodiments, it is to be appreciated that other constructions and arrangements are considered as falling within the scope of the invention. Various modifications, alterations, variations and/or additions to the constructions and arrangements described herein are also considered as falling within the scope and ambit of the present invention.

I claim:

1. A sweeping device including a moulded head portion having an upper surface and a lower surface, a socket for attaching the sweeping device to a broom stick moulded on the upper surface, integral with the head portion and of the same material as the rest of the head portion, and a moulded bristle portion having a plurality of integrally formed bristles engaged with the head portion, the bristle portion being formed of material of lesser hardness than the material forming the head portion, and the socket being located intermediate the ends of an elongate reinforcement member forming part of the head portion.

2. A sweeping device according to claim 1 wherein the head portion is moulded from a composition including a substantial proportion of polymeric material.

3. A sweeping device according to claim 2 wherein the polymeric material is polypropylene or a co-polymer of polypropylene and polystyrene.

4. A sweeping device according to claim 2 wherein the material of the head portion includes 10% to 45% by weight of talc.

5. A sweeping device according to claim 4 wherein the material of the head portion includes 15% to 25% by weight of talc.

6. A sweeping device according to claim 1 wherein the bristle portion is moulded from a composition which includes a rubber material.

7. A sweeping device according to claim 6 wherein the bristle portion is moulded from a composition which also includes a proportion of plastic material.

8. A sweeping device according to claim 1 wherein the socket is reinforced by one or more reinforcing webs extending between the socket and the elongate reinforcement member.

9. A sweeping device according to claim 1 wherein the head portion includes attachment means for facilitating attachment of the bristle portion thereto.

10. A sweeping device according to claim 9 wherein the attachment means include one or more grooves, recesses, raised portions or projections formed on the head portion.

11. A sweeping device according to claim 9 wherein the bristle portion partly overlies and/or envelops the attachment means.

12. A sweeping device according to claim 1 wherein a groove is provided to extend substantially around the elongate reinforcement member near the perimeter thereof.

13. A sweeping device according to claim 1 wherein the lower surface of the head portion is provided with raised portions in the form of projections, lugs or stippling.

14. A sweeping device according to claim 1 wherein a proportion of the bristles have a larger cross-section than the remainder of the bristles.

15. A sweeping device according to claim 14 wherein the bristles of larger cross-section have a D, rectangular or square shaped cross-section.

16. A sweeping device according to claim 1 wherein the bristle portion includes a squeegee blade integrally formed therewith.

17. A method of manufacturing a sweeping device including the steps of moulding a head portion with a socket extending therefrom and thereafter moulding a bristle portion of softer material than the material forming the head portion to overlie and partially envelop the first portion to attach the bristle portion to the head portion said bristle portion being moulded with a plurality of integrally formed bristles.

18. A method according to claim 17 wherein the material of the bristle portion is moulded to overlie and engage one or more recessed and/or projecting portions formed in the head portion.

19. A method according to claim 18 wherein the bristle portion is moulded onto the head portion in such a manner as to leave the socket and central portion of the head portion free of overlap with the bristle portion.

* * * * *